US012799605B2

(12) United States Patent
Cai et al.

(10) Patent No.: US 12,799,605 B2
(45) Date of Patent: Nov. 17, 2026

(54) LIQUID METAL SUBSTRATE CLEANING METHOD AND CLEANING AND COATING INTEGRATED DEVICE

(71) Applicant: YUNNAN ZHONGXUAN LIQUID METAL TECHNOLOGY CO., LTD, Qujing (CN)

(72) Inventors: Changli Cai, Qujing (CN); Chengdu Geng, Qujing (CN); Wangli Du, Qujing (CN); Yingbao Yang, Qujing (CN); Ji Zhang, Qujing (CN); Jianping An, Qujing (CN); Huifang Tang, Qujing (CN); Linghang Kong, Qujing (CN)

(73) Assignee: YUNNAN ZHONGXUAN LIQUID METAL TECHNOLOGY CO., LTD., Qujing (CN)

( * ) Notice: Subject to any disclaimer, the term of this patent is extended or adjusted under 35 U.S.C. 154(b) by 201 days.

(21) Appl. No.: 18/725,242

(22) PCT Filed: Jan. 4, 2023

(86) PCT No.: PCT/CN2023/070416
§ 371 (c)(1),
(2) Date: Jun. 28, 2024

(87) PCT Pub. No.: WO2024/055486
PCT Pub. Date: Mar. 21, 2024

(65) Prior Publication Data

US 2025/0066926 A1 Feb. 27, 2025

(30) Foreign Application Priority Data

Sep. 13, 2022 (CN) ..... 202211111691.3

(51) Int. Cl.
*C23G 3/00* (2006.01)
*C23G 1/02* (2006.01)
*C23G 5/02* (2006.01)

(52) U.S. Cl.
CPC ..... *C23G 3/00* (2013.01); *C23G 1/02* (2013.01); *C23G 5/02* (2013.01)

(58) Field of Classification Search
CPC ..... G01N 2021/8461
See application file for complete search history.

(56) References Cited

U.S. PATENT DOCUMENTS

2008/0165502 A1* 7/2008 Furman ..... H10W 40/77 257/E23.09

FOREIGN PATENT DOCUMENTS

CN 109068499 A 12/2018
CN 109089382 A 12/2018
(Continued)

OTHER PUBLICATIONS

"Thin Film Physics and Devices" (Nat'l Defense Industry Press, May 2011) (Year: 2011).*
(Continued)

*Primary Examiner* — Kaj K Olsen
*Assistant Examiner* — Richard Z. Zhang
(74) *Attorney, Agent, or Firm* — Rondaus PLLC; George Liu

(57) ABSTRACT

Provided in the present disclosure is a liquid metal substrate cleaning method and cleaning and coating integrated device, belonging to the technical field of thermal interface materials construction. The above-mentioned method includes a substrate cleaning and a cleaning qualification inspection, wherein the substrate cleaning comprises a plasma cleaning, an inorganic cleaning reagent cleaning, and an organic reagent cleaning, and any combination of the plasma clean-
(Continued)

ing, the inorganic cleaning reagent cleaning and the organic reagent cleaning; and the cleaning qualification inspection is judged as qualified or not based on a diffusion area of the organic reagent on a surface of the liquid metal substrate, and when the diffusion area meets a predetermined requirement, the cleaning is finished; and when the diffusion area does not meet the predetermined requirement, the substrate cleaning step is repeated, and the steps are repeated in this way until the diffusion area meets the predetermined requirement.

9 Claims, 3 Drawing Sheets

(56) References Cited

FOREIGN PATENT DOCUMENTS

| | | | | |
|---|---|---|---|---|
| CN | 113053723 | A | * | 6/2021 |
| CN | 115522205 | A | | 12/2022 |
| JP | H10300677 | A | * | 11/1998 |

OTHER PUBLICATIONS

Xiao, Dingquan et al. "Cleaning of Substrate", Thin Film Physics and Devices. ISBN 978-7-118-07238-9, May 31, 2011 (May 31, 2011), pp. 114-116.

* cited by examiner

LIQUID METAL SUBSTRATE CLEANING METHOD AND CLEANING AND COATING INTEGRATED DEVICE

CROSS-REFERENCE TO RELATED APPLICATIONS

This application claims priority to Chinese Patent Application No. 202211111691.3, titled "LIQUID METAL SUBSTRATE CLEANING METHOD AND CLEANING AND COATING INTEGRATED DEVICE", filed on Sep. 13, 2022, which are incorporated herein by reference in their entirety.

TECHNICAL FIELD

The present disclosure herein relates to the technical field of thermal interface materials construction, in particular to a liquid metal substrate cleaning method and cleaning and coating integrated device.

BACKGROUND

Compared with the traditional silicone grease, liquid metal is difficult to be coated on the surface of the chip and the radiator because of the large surface tension. Poor coating will seriously affect the heat dissipation performance of the chip and cause product defects. At present, there are mainly two ways: first, the liquid metal is modified to increase the viscosity of the liquid metal at the expense of some thermal conductivity, which can reduce the difficulty of coating the liquid metal on the substrate to some extent; secondly, solving the coating problem of liquid metal by repeatedly brushing for dozens of times. The principle is similar to that of modification treatment, which also sacrifices part of thermal conductivity and shortens the service life of liquid metal. Neither of the two methods can solve the wetting problem between liquid metal and substrate well. Therefore, it is necessary to find a method that can solve the wetting problem between liquid metal and substrate without reducing the performance of liquid metal, and at the same time ensure the convenience of manufacturing and mass production.

Because liquid metal is a new industry, there is no integrated device suitable for liquid metal substrate cleaning and liquid metal coating in the current market. The traditional solution is to use multiple single-function devices together, which is not conducive to the promotion and application of the industry.

The information disclosed in this background is only intended to increase the understanding of the general background of the present disclosure, and should not be taken as an admission or any form of suggestion that this information constitutes the prior art that is known to those skilled in the art.

SUMMARY

In order to solve the technical problems in the prior art that liquid metal coating is difficult and the thermal conductivity of liquid metal is sacrificed, a liquid metal substrate cleaning method and cleaning and coating integrated device are provided.

The present disclosure is mainly realized by cleaning the chip and radiator, Although the chip and radiator are relatively clean to human eyes, there is actually a thin layer of stains on their surfaces, which mainly contain organic matter and inorganic matter. As long as these two kinds of substances are cleaned, liquid metal has good wettability to the chip and radiator in theory.

In the first aspect of the present disclosure, a cleaning method for a liquid metal substrate is provided, comprising a substrate cleaning and a cleaning qualification inspection, and the steps are as follows:

the substrate cleaning comprises a plasma cleaning, and/or an inorganic cleaning reagent cleaning, and/or an organic reagent cleaning, and one or any combination of the plasma cleaning, the inorganic cleaning reagent cleaning and the organic reagent cleaning; and the cleaning qualification inspection is judged as qualified or not based on a diffusion area of the organic reagent on a surface of the liquid metal substrate, and when the diffusion area meets a predetermined requirement, the cleaning is finished; and when the diffusion area does not meet the predetermined requirement, the substrate cleaning step is repeated, and the steps are repeated in this way until the diffusion area meets the predetermined requirement. Preferably, the above predetermined requirement is that the maximum area of the organic reagent diffusion on the substrate surface after cleaning is not less than 6.5 times of the area before cleaning; and the above organic reagent is preferably anhydrous ethanol.

In some embodiments, the inorganic cleaning reagent is selected from one of a sodium bicarbonate solution, a low-concentration strong acid solution, a high-concentration weak acid solution, a low-concentration strong alkali solution and a high-concentration weak alkali solution.

In some embodiments, the strong acid solution is selected from one or more of dilute hydrochloric acid, dilute sulfuric acid, dilute nitric acid, hydrobromic acid, hydroiodic acid, phosphoric acid and permanganic acid;

and/or, the weak acid solution is selected from hydrofluoric acid and/or acetic acid;

and/or, the strong alkali solution is selected from one or more of sodium oxide, potassium hydroxide and barium hydroxide;

and/or, the weak alkaline solution is selected from sodium bicarbonate and/or sodium carbonate.

In some embodiments, the organic reagent is selected from one or more of alcohols, hydrocarbons, ethers, esters and ketones.

In some embodiments, the organic reagent is selected from one or more of ethanol, methanol, dipropylene glycol butyl ether, diethylene glycol butyl ether, hydrocarbon, acetone, toluene, ethyl acetate and ethyl ether.

In some embodiments, the substrate cleaning includes the following method steps:

method ①: the plasma cleaning;

and/or, method ②: the inorganic cleaning reagent cleaning;

and/or, method ③: the organic reagent cleaning;

and/or, method ④: a combined cleaning, the plasma cleaning first, and then the inorganic cleaning reagent cleaning;

and/or, method ⑤: a combined cleaning, the plasma cleaning first, and then the organic reagent cleaning;

and/or, method ⑥: a combined cleaning, the inorganic cleaning reagent cleaning first, and then the plasma cleaning;

and/or, method ⑦: a combined cleaning, the inorganic cleaning reagent cleaning first, and then the organic reagent cleaning;

and/or, method ⑧: a combined cleaning, the organic reagent cleaning first, and then the plasma cleaning;

and/or, method ⑨: a combined cleaning, the organic reagent cleaning first, and then the inorganic cleaning reagent cleaning;

and/or, method ⑩: a combined cleaning, the plasma cleaning first, then the inorganic cleaning reagent cleaning, and finally the organic reagent cleaning;

and/or, the method ⑪: a combined cleaning, the plasma cleaning first, then the organic reagent cleaning, and finally the inorganic cleaning reagent cleaning;

and/or, the method ⑫: a combined cleaning, the inorganic cleaning reagent cleaning first, then the plasma cleaning, and finally the organic reagent cleaning;

and/or, a method ⑬; a combined cleaning, the inorganic cleaning reagent cleaning first, then the organic reagent cleaning, and finally the plasma cleaning;

and/or, the method ⑭: a combined cleaning, the organic reagent cleaning first, then the plasma cleaning, and finally the inorganic cleaning reagent cleaning;

and/or, the method ⑮: a combined cleaning, the organic reagent cleaning first, then the inorganic cleaning reagent cleaning, and finally the plasma cleaning.

The above cleaning methods are one or a combination of cleaning methods, and the above methods can be selected according to actual needs.

In some embodiments, the inorganic cleaning reagent is sodium bicarbonate solution, and the organic reagent is anhydrous ethanol.

In the second aspect of the present disclosure, a liquid metal substrate cleaning and coating integrated device is provided, comprising an integration platform, a cleaning unit, an erasing unit, a coating unit and an image sensor are installed on the integration platform, and the integration platform is installed on a moving mechanism. The functions of cleaning, erasing and coating are integrated into one device, and the image information is captured by the image sensor and transmitted to the control system, to realize the movement and positioning of the device. Then, the substrate is repeatedly cleaned and erased according to the program, so that the oil stains on the surface of the substrate are thoroughly cleaned, and the cleaned substrate is directly coated, eliminating the intermediate transfer step and avoiding secondary pollution.

In some embodiments, the cleaning unit includes a plurality of cleaning devices, the erasing unit is provided with at least one erasing device, and the coating unit is provided with at least one coating device. Preferably, the cleaning device comprises a plasma cleaning machine, a first wiping head and a second wiping head, wherein the first wiping head is filled with the above-mentioned inorganic reagent, and the second wiping head is filled with the above-mentioned organic reagent.

The above-mentioned working method of the integrated device comprises the following steps:

substrate cleaning: the surface of the liquid metal substrate is cleaned via one or any combination of the plasma cleaning machine, the first wiping head and the second wiping head, and the surface of the liquid metal substrate is dried via the erasing device after each cleaning;

substrate detection: the organic cleaning reagent in the second wiping head is dropped onto the surface of the liquid metal substrate, the substrate detection is judged as qualified or not based on a diffusion area of the organic reagent on the surface of the liquid metal substrate, and when the diffusion area meets a predetermined requirement, the cleaning is finished; and when the diffusion area does not meet the predetermined requirement, the substrate cleaning step is repeated, and the steps are repeated in this way until the diffusion area meets the predetermined requirement; and coating liquid metal: a liquid metal coating device is controlled via a control unit to apply liquid metal coating to the liquid metal substrate.

In some embodiments, the working units of the cleaning device, the erasing device and the coating device are all exposed outside the integration platform, and face vertically downwards. The plug-in design is compatible with the installation of most traditional production lines.

In some embodiments, the cleaning device and the coating device are respectively provided with accommodating cavities for holding cleaning liquid and liquid metal.

In some embodiments, the cleaning device comprises the plasma cleaning machine, the first wiping head and the second wiping head, wherein the first wiping head is filled with sodium bicarbonate solution, and the second wiping head is filled with anhydrous ethanol.

In some embodiments, the moving mechanism comprises an X-direction sliding table and a Z-direction sliding table, and the integration platform can move left or right relative to the X-direction sliding table, and can move up or down relative to the Z-direction sliding table, respectively.

In some embodiments, the moving mechanism further comprises a Y-direction sliding table, and the integration platform can move back or forth relative to the Y-direction sliding table. The movement of the integrated platform in three-dimensional space is realized by setting the X-direction sliding table, the Z-direction sliding table and the Y-direction sliding table.

In some embodiments, the integrated device further comprises a first supporting frame and a second supporting frame, wherein the first supporting frame is fixedly connected with one end of the X-direction sliding table, and the second supporting frame is fixedly connected with the other end of the X-direction sliding table.

In some embodiments, the bottom of the first supporting frame and the second supporting frame are respectively provided with connectors. The first supporting frame and the second supporting frame are fixed to the production line platform via the connectors.

Compared with the prior art, the present disclosure has the following technical effects:

(1) compare with that traditional solution, according to the method and the device, the surfaces of substrates such as chips and radiators are thoroughly cleaned, and the problem of non-wettability between the liquid metal and the substrate is fundamentally solved, so that the unmodified liquid metal stock can be quickly and uniformly coated on the surface of the substrate such as the chip and the radiator without losing the thermal conductivity of the liquid metal; and the liquid metal has good contact with substrates such as chips and radiators, has no barrier of a stain film layer, and has better heat dissipation effect; because of the good contact between the liquid metal and substrates, liquid metal sticks between the chip and the radiator, and because of the large surface tension, the problem of easy leakage of liquid metal is also alleviated. If the device and method are not cleaned or not cleaned well, liquid metal will easily flow out between the chip and the radiator, resulting in heat dissipation failure.

(2) The integrated device of the present disclosure, integrated for liquid metal substrate cleaning, cleaning effect detection, and coating, which has met the automation requirements of liquid metal industry, and the plug-in design is compatible with the installation of most traditional production lines, which can quickly realize the upgrading of traditional production lines and the design of various cleaning methods, and is also convenient for manufacturers to choose according to actual conditions.

1—integration platform; 21—plasma cleaning machine; 22—the first wiping head; 23—the second wiping head; 3—erasing unit; 4—coating unit; 5—image sensor; 6—moving mechanism; 61—X-direction sliding table; 62—Z-direction sliding table; 63—Y-direction sliding table; 71—first supporting frame; 711—first groove; 72—second supporting frame; 721—second groove; 8—connector; 9—production line platform; and 10—substrate sample.

DETAILED DESCRIPTION OF THE EMBODIMENTS

In the following, the technical scheme of the present disclosure will be explained through specific embodiments with the accompanying drawings. It should be understood that one or more steps mentioned in the present disclosure do not exclude the existence of other methods and steps before and after the combination step, or other methods and steps can be inserted between these explicitly mentioned steps. It should also be understood that these examples are only used to illustrate the present disclosure and are not used to limit the scope of the present disclosure. Unless otherwise specified, the numbering of each method step is only for the purpose of identifying each method step, and does not limit the arrangement order of each method or limit the scope of implementation of the present disclosure. The change or adjustment of its relative relationship can also be regarded as the scope of implementation of the present disclosure without changing the substantive technical content.

The raw materials and instruments used in the embodiments have no specific restrictions on their sources, and can be purchased in the market or prepared by conventional methods familiar to those skilled in the art.

Figure 1:
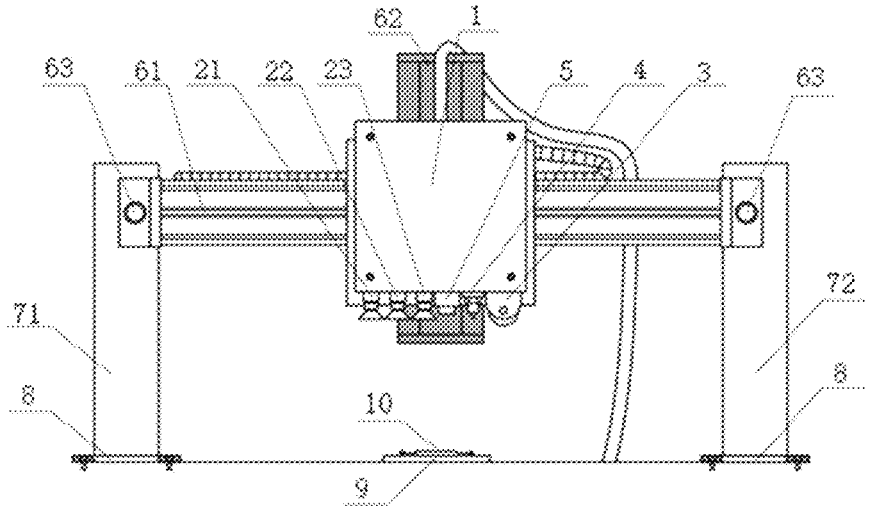
FIG. 1 is a structural schematic diagram or the present disclosure.
Figure 2:
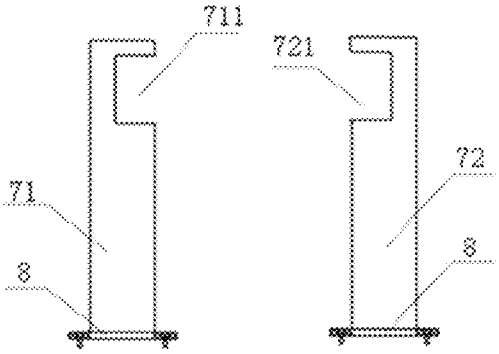
FIG. 2 is a structural schematic diagram of a first supporting frame and a second supporting frame.

As shown in FIG. 1-FIG. 2, a liquid metal substrate cleaning and a coating integrated device, comprising an integration platform 1, wherein a cleaning unit, an erasing unit 3 and a coating unit 4 are installed on the integration platform 1, the integration platform 1 is installed on a moving mechanism 6, and the integrated device further comprises an image sensor 5 for capturing image information.

The cleaning unit comprises a plasma cleaning machine 21, a first wiping head 22 and a second wiping head 23, wherein the first wiping head 22 is a sodium bicarbonate solution wiping head and the second wiping head 23 is an anhydrous alcohol wiping head; the erasing unit 3 is provided with an erasing device; and the coating unit 4 is provided with a coating device; each device is arranged in turn in the transverse direction, and the working units of each device are exposed outside the integration platform 1, perpendicular to a substrate sample 10; and each cleaning device is respectively provided with an accommodating cavity for holding a cleaning reagent, and the coating device is provided with an accommodating cavity for holding liquid metal.

The moving mechanism 6 comprises an X-direction sliding table 61 and a Z-direction sliding table 62, and the integration platform 1 can move left or right relative to the X-direction sliding table 61, and can move up or down relative to the Z-direction sliding table 62, respectively, and also comprises a Y-direction sliding table 63, and the integration platform 1 can move back and forth relative to the Y-direction sliding table 63.

The moving mechanism 6 is any device in the prior art that can realize two-dimensional or three-dimensional space movement. In this embodiment, the integration platform 1 is fixedly connected with a fixing piece, and the fixing piece is slid and installed on the Z-direction sliding table 62; two ends of the X-direction sliding table 61 are respectively fixed on a first supporting frame 71 and a second supporting frame 72. Specifically, a first groove 711 is arranged on the first supporting frame 71, a second groove 721 is arranged on the second supporting frame, one end of the X-direction sliding table 61 is installed on the first groove 711, and the other end is installed on the second groove 721. The Z-direction sliding table 62 is slid and installed on the X-direction sliding table 61, and the Z-direction sliding table 62 can drive the integration platform 1 and its devices to move left or right along the X-direction sliding table; and in order to increase the function of forward or backward movement of the integration platform 1, both ends of the X-direction sliding table 61 slide the Y-direction sliding table 62 respectively, thus realizing the forward or backward movement of the integration platform 1 along the Y-axis direction.

The bottom of the first supporting frame 71 and the second supporting frame 72 are respectively provided with connectors 8, which are integrated devices and fixed on both sides of the production line platform 9.

In this embodiment, each cleaning device, erasing device, coating device and image sensor 5 are connected with the Programmable Logic Controller (PLC) control system, and automation is realized through PLC control.

The working process of the liquid metal substrate cleaning and coating integrated device is as follows:

Step 1: the image sensor 5 transmits the image of the construction area to the computer, the builder marks the work piece area on the image, checks the required cleaning program, and the computer works according to the set program.

Step 2: classification of cleaning procedures procedure ①: controlling the plasma cleaning machine 21 to perform plasma cleaning on the target area;

procedure ②: controlling the sodium bicarbonate solution spray nozzle to spray sodium bicarbonate solution on the target area, and controlling the erasing device to clean and dry the target area;

procedure ③: controlling the anhydrous alcohol wiping head to spray anhydrous alcohol on the target area, and controlling the erasing device to clean and dry the target area;

procedure ④: proceeding with procedure ①first, and then proceeding with procedure ②;

procedure ⑤: proceeding with procedure ②first, and then proceeding with procedure ③;

procedure ⑥: proceeding with procedure ②first, and then proceeding with procedure ①;

procedure ⑦: proceeding with procedure ②first, and then proceeding with procedure ③;

procedure ⑧: proceeding with procedure ③first, and then proceeding with procedure ①;

procedure ⑨D: proceeding with procedure ③first, and then proceeding with procedure ②;

procedure ⑩: proceeding with procedure ①first, then proceeding with procedure ②, and finally proceeding with procedure ③;

procedure ⑪: proceeding with procedure ①first, then proceeding with procedure ③, and finally proceeding with procedure ②;

procedure ⑫: proceeding with procedure ②first, then proceeding with procedure ①, and finally proceeding with procedure ③;

procedures ⑬: proceeding with procedure ②first, then proceeding with procedure ③, and finally proceeding with procedure ①;

procedure ⑭: proceeding with procedure ③first, then proceeding with procedure ①, and finally proceeding with procedure ②; and procedure ⑮: proceeding with procedure ③first, then proceeding with procedure ②, and finally proceeding with procedure ①;

Step 3: detection of cleaning effect

After the cleaning step is completed, the cleaning is detected qualified or not based on the diffusion area of the organic reagent, and the larger the diffusion area, the cleaner the substrate is. Specifically, the computer controls the anhydrous ethanol wiping head to drop a drop of anhydrous ethanol on the work piece, and then controls the image sensor 5 to collect images and upload the images to the computer, and the computer calculates that the maximum area of anhydrous ethanol after diffusion is not less than 6.5 times of the area just dropped, and if it is less than the set value, it will enter the cleaning step again, and if it is greater than or equal to the set value, it will enter the next step;

Step 4: spraying liquid metal

The computer controls the liquid metal coating device to coat the work piece with liquid metal.

Figure 4:
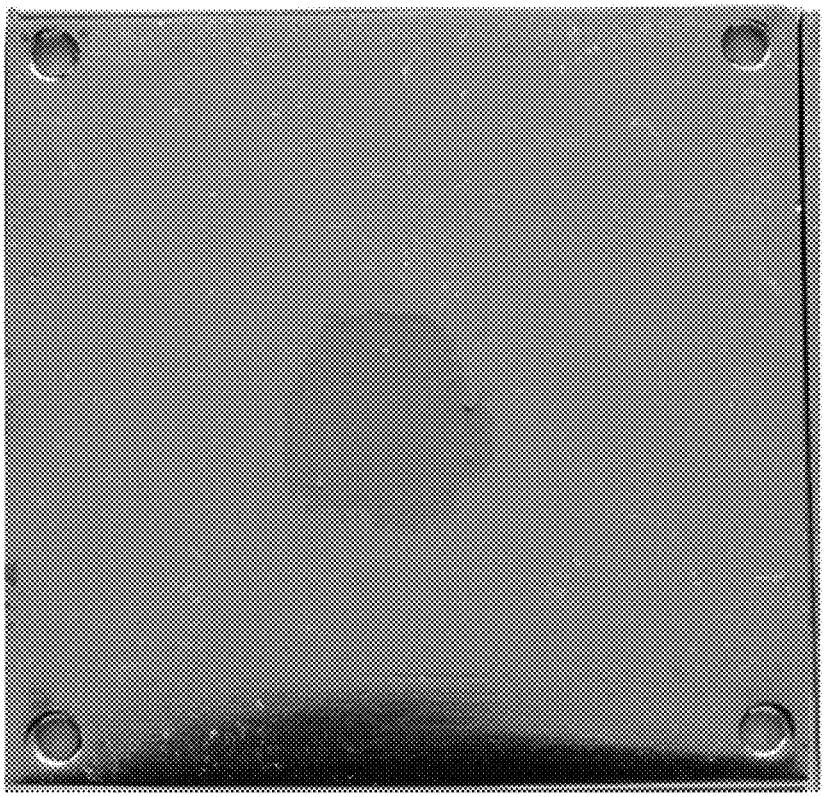
FIG. 4 is a photo of a test result of Experiment 2.

Comparative experiment:

Experiment 1: a nickel-plated copper block used to simulate the radiator was taken out, cleaned with sodium bicarbonate solution, and a drop of anhydrous ethanol was dropped for inspection. The inspection result is shown in FIG. 3;

Experiment 2: a nickel-plated copper block used to simulate the radiator was taken out, cleaned with anhydrous alcohol, and a drop of alcohol was dropped for inspection. The inspection result is shown in FIG. 4; and Experiment 3: a nickel-plated copper block used to simulate the radiator was taken out, cleaned with plasma cleaning agent and sodium bicarbonate solution, followed by ethanol, and a drop of alcohol was dropped for inspection. The inspection result is shown in FIG. 5.

Figure 3:
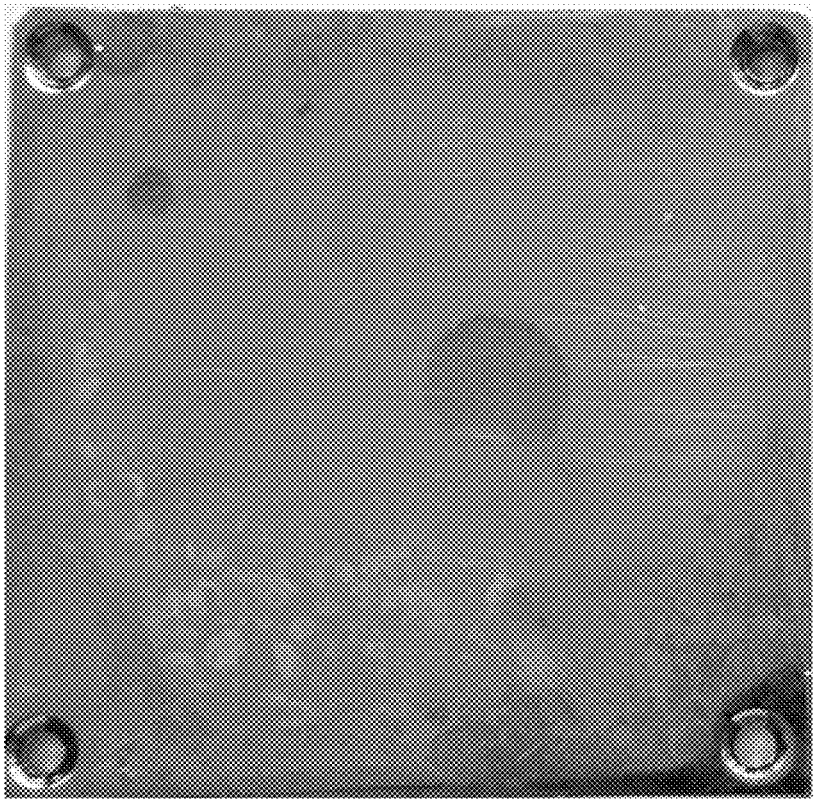
FIG. 3 is a photo of a test result of Experiment 1.
Figure 5:
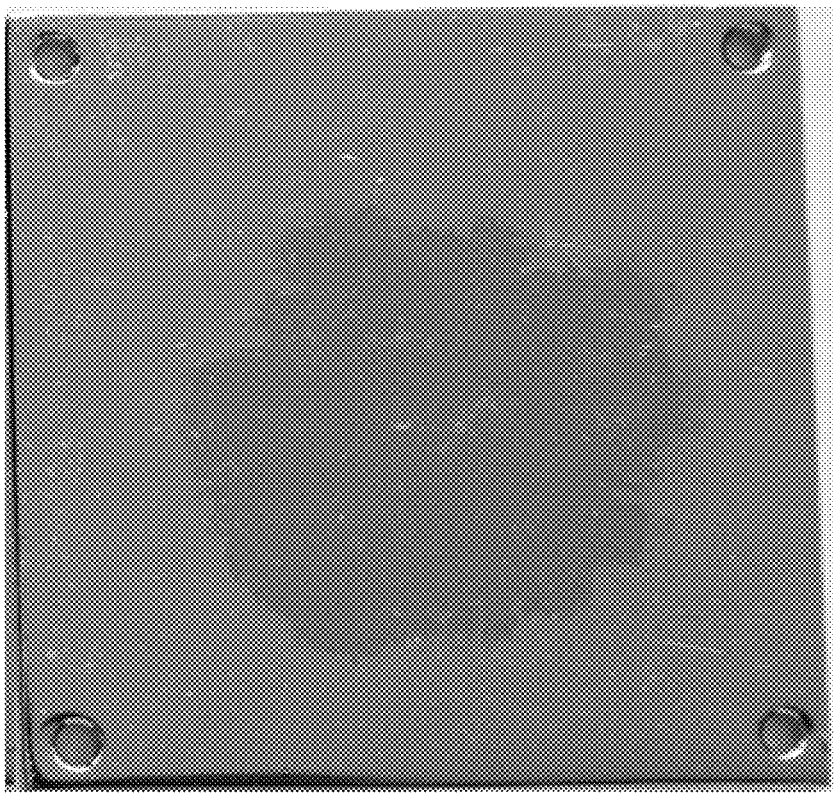
FIG. 5 is a photo of a test result of Experiment 3.

Comparing FIG. 3 to FIG. 5, it can be seen that the liquid metal diffuses well on the surface of nickel-plated copper blocks cleaned with sodium bicarbonate and ethanol respectively, indicating that the liquid metal exhibits good wettability on the nickel-plated copper block after cleaning.

Obviously, the problem that liquid metal and the substrate are not wetted can be fundamentally solved by repeatedly cleaning nickel-plated copper blocks using the integrated device of the present disclosure.

The sodium bicarbonate solution used in the present disclosure can be replaced by aqueous solutions of dilute hydrochloric acid, dilute sulfuric acid, dilute nitric acid, hydrobromic acid, hydroiodic acid, phosphoric acid, permanganic acid, carbonic acid, acetic acid, hydrofluoric acid, sodium hydroxide, potassium hydroxide, barium hydroxide and sodium carbonate;

the anhydrous ethanol used in the present disclosure can be replaced by methanol, dipropylene glycol butyl ether, diethylene glycol butyl ether, hydrocarbon, acetone, toluene, ethyl acetate and ether;

the method used in the present disclosure can also be used for plating or bonding liquid metal materials on some materials, such as plastic film materials, metal materials and ceramic materials; and the cleaning method and the cleaning qualified detection method can also be used in the fields of welding and plating of metal materials.

The foregoing description of specific exemplary embodiments of the present disclosure is for the purpose of explanation and illustration. These descriptions are not intended to limit the present disclosure to the precise form disclosed, and obviously, many changes and variations may be made in accordance with the above teachings. The purpose of selecting and describing exemplary embodiments is to explain the particular principle of the present disclosure and its practical application, so as to enable those skilled in the art to realize and utilize various exemplary embodiments and various choices and changes of the present disclosure. The scope of the present disclosure is intended to be defined by the claims and their equivalents.

In the description of the present disclosure, it should be understood that the terms "center", "vertical", "horizontal", "length", "width", "thickness", "up", "down", "front", "back", "left", "right", "vertical", "horizontal", "top", "bottom", "inner", "outer", "clockwise", "counterclockwise", "axial", "radial", "circumferential", etc. indicate that the orientation or position relationship is based on the orientation or position relationship shown in the accompanying drawings, and is only for the convenience of describing the present disclosure and simplifying the description, rather than indicating or implying that the device or element referred to must have a specific orientation, be constructed and operated in a specific orientation, therefore it cannot be understood as limitations to the present disclosure.

In addition, the terms "first", "second" and so on are only used for descriptive purposes, and cannot be understood as indicating or implying relative importance or implicitly indicating the number of indicated technical features. In the description of the present disclosure, "a plurality of" means more than two, unless otherwise specifically defined.

What is claimed is:

1. A cleaning method for a substrate to be coated with liquid metal, comprising a substrate cleaning step and a cleaning qualification inspection step, wherein:

the substrate cleaning step comprises one or more of a plasma cleaning, an inorganic reagent cleaning, and an organic reagent cleaning, and any combination of the plasma cleaning, the inorganic reagent cleaning and the organic reagent cleaning; and the cleaning qualification inspection step comprises dropping an organic reagent onto a surface of the substrate to produce a diffusion area on the substrate and determining whether or not the diffusion area meets a predetermined requirement, wherein the predetermined requirement is that a maximum area of diffusion of the organic reagent on the surface of the substrate after cleaning is not less than 6.5 times of a reference diffusion area of the organic reagent on the surface of the substrate before cleaning, and wherein when the diffusion area meets the predetermined requirement, the substrate is finished with cleaning; and when the diffusion area does not meet the predetermined requirement, a sequence of the substrate cleaning step followed by the cleaning qualification inspection step is repeated until the diffusion area meets the predetermined requirement.

2. The cleaning method according to claim 1, wherein an inorganic reagent for the inorganic reagent cleaning is one selected from a sodium bicarbonate solution, a strong acid solution, a weak acid solution, a strong alkali solution and a weak alkali solution.

3. The cleaning method according to claim 2, wherein the strong acid solution is one or more selected from hydrochloric acid, sulfuric acid, nitric acid, hydrobromic acid, hydroiodic acid, phosphoric acid and permanganic acid;

and/or, the weak acid solution is hydrofluoric acid and/or acetic acid;

and/or, the strong alkali solution is one or more selected from sodium oxide, potassium hydroxide and barium hydroxide;

and/or, the weak alkali solution is sodium carbonate.

4. The cleaning method according to claim 1, wherein the organic reagent comprises one organic compound, or a mixture of two or more organic compounds, and each organic compound is independently an alcohol, a hydrocarbon, an ether, an ester, or a ketone.

5. The cleaning method according to claim 1, wherein the organic reagent is one or more selected from ethanol, methanol, dipropylene glycol butyl ether, diethylene glycol butyl ether, acetone, toluene, ethyl acetate and ethyl ether.

6. A substrate cleaning and coating integrated device comprising an integration platform, a cleaning unit, an erasing unit, a coating unit, an image sensor, a moving mechanism, and a controller programmed to perform the cleaning method according to claim 1, wherein the cleaning unit, the erasing unit, the coating unit, and the image sensor are installed on the integration platform, and the integration platform is installed on the moving mechanism.

7. The integrated device according to claim 6, wherein the cleaning unit comprises a plurality of cleaning devices selected from a group consisting of a plasma cleaning machine, a first wiping head and a second wiping head, wherein the first wiping head is filled with an inorganic reagent, and the second wiping head is filled with an organic reagent.

8. The integrated device according to claim 7, wherein the moving mechanism comprises an X-direction sliding table and a Z-direction sliding table, and the integration platform is arranged to move left or right relative to the X-direction sliding table, and is arranged to move up or down relative to the Z-direction sliding table, respectively.

9. A method of using the integrated device according to claim 7, comprising the following steps:

a substrate cleaning step comprising: cleaning a surface of a substrate via one or more of the plasma cleaning machine, the first wiping head and the second wiping head, and then drying the surface of the substrate via the erasing unit;

a cleaning qualification inspection step comprising: dropping the organic reagent in the second wiping head onto the surface of the substrate, and determining whether or not a diffusion area of the organic reagent dropped onto the surface of the substrate meets the predetermined requirement, wherein when the diffusion area meets the predetermined requirement, the substrate is finished with cleaning; and wherein when the diffusion area does not meet the predetermined requirement, a sequence of the substrate cleaning step followed by the cleaning qualification inspection step is repeated until the diffusion area meets the predetermined requirement; and applying a liquid metal coating to the cleaned surface of the substrate.

* * * * *